US008604899B2

(12) United States Patent
Galletti et al.

(10) Patent No.: US 8,604,899 B2
(45) Date of Patent: Dec. 10, 2013

(54) ELECTRICAL TRANSFORMER WITH DIAPHRAGM AND METHOD OF COOLING SAME

(75) Inventors: Bernardo Galletti, Nussbaumen (CH); Arthouros Iordanidis, Baden (CH); Jasmin Smajic, Schöfflisdorf (CH); Martin Carlen, Niederrohrdorf (CH)

(73) Assignee: Abb Research Ltd., Zürich (CH)

( * ) Notice: Subject to any disclaimer, the term of this patent is extended or adjusted under 35 U.S.C. 154(b) by 0 days.

(21) Appl. No.: 13/510,541

(22) PCT Filed: Nov. 17, 2010

(86) PCT No.: PCT/EP2010/067632

§ 371 (c)(1), (2), (4) Date: Aug. 1, 2012

(87) PCT Pub. No.: WO2011/061207

PCT Pub. Date: May 26, 2011

(65) Prior Publication Data

US 2012/0299677 A1 Nov. 29, 2012

(30) Foreign Application Priority Data

Nov. 17, 2009 (EP) ..... 09176206

(51) Int. Cl.

| | |
|---|---|
| ***H01F 27/08*** | (2006.01) |
| ***H01F 27/10*** | (2006.01) |
| ***H01F 27/02*** | (2006.01) |
| ***H01F 27/28*** | (2006.01) |

(52) U.S. Cl.

USPC ..... 336/61; 336/57; 336/58; 336/59; 336/60; 336/90; 336/179; 336/180; 336/184

(58) Field of Classification Search

USPC ..... 336/61, 57, 58, 59, 60, 90, 170, 180, 336/184

See application file for complete search history.

(56) References Cited

U.S. PATENT DOCUMENTS

| | | | |
|---|---|---|---|
| 2,388,565 | A | 11/1945 | Paluev |
| 2,459,322 | A | 1/1949 | Johnston |

(Continued)

FOREIGN PATENT DOCUMENTS

| | | | |
|---|---|---|---|
| DE | 909 122 | C | 4/1954 |
| DE | 1 563 160 | A1 | 4/1970 |

(Continued)

OTHER PUBLICATIONS

International Search Report (PCT/ISA/210) issued on Apr. 1, 2010, by the European Patent Office as the International Searching Authority for International Application No. PCT/EP2010/067632.

(Continued)

*Primary Examiner* — Elvin G Enad
*Assistant Examiner* — Kazi Hossain
(74) *Attorney, Agent, or Firm* — Buchanan Ingersoll & Rooney PC

(57) ABSTRACT

An electrical transformer is disclosed which includes an enclosure; a magnetic core assembly arranged within the enclosure, the magnetic core assembly having a first core limb, a second core limb and a third core limb; and three coil assemblies having a first coil assembly, a second coil assembly, and a third coil assembly. At least two diaphragms are arranged within the enclosure, the diaphragms being essentially sealed to a first outermost coil of the first coil assembly, and arranged for guiding a cooling fluid in series through a first inner fluid duct, a second inner fluid duct, a third inner fluid duct and an extra-coil volume along outsides of third, second and first outermost coil coils of the third, second and first coil assemblies.

20 Claims, 2 Drawing Sheets

(56) References Cited

U.S. PATENT DOCUMENTS

| | | | | | |
|---|---|---|---|---|---|
| 2,615,075 | A | * | 10/1952 | Paluev | 165/47 |
| 2,751,562 | A | | 6/1956 | Camilli et al. | |
| 2,927,736 | A | | 3/1960 | Rohatyn | |
| 3,264,589 | A | * | 8/1966 | Dutton | 336/57 |
| 3,548,354 | A | * | 12/1970 | Schwab | 336/57 |
| 2004/0070475 | A1 | * | 4/2004 | Nick et al. | 336/61 |
| 2007/0247266 | A1 | * | 10/2007 | Yargole et al. | 336/61 |

FOREIGN PATENT DOCUMENTS

| | | | |
|---|---|---|---|
| GB | 691849 | | 5/1953 |
| WO | WO 02/082478 | A1 | 10/2002 |

OTHER PUBLICATIONS

Written Opinion (PCT/ISA/237) issued on Apr. 1, 2010, by the European Patent Office as the International Searching Authority for International Application No. PCT/EP2010/067632.

European Search Report issued on Apr. 14, 2012 for European Application No. 09176206.2.

International Preliminary Report on Patentability (PCT/IB/373) issued on May 22, 2012, by the European Patent Office as the International Searching Authority for International Application No. PCT/EP2010/067632.

* cited by examiner

ELECTRICAL TRANSFORMER WITH DIAPHRAGM AND METHOD OF COOLING SAME

Aspects of the invention relate to an electrical transformer, in particular to an electrical transformer having an enclosure, and more particularly further having a magnetic core assembly and at least two coil assemblies arranged therein. Further aspects relate to a method for cooling such an electrical transformer.

TECHNICAL BACKGROUND

Electrical transformers have become more and more powerful over the time, and capable of transforming ever higher voltages, currents, and power. An important limitation of such transformers, especially dry transformers, is their cooling. If cooling is insufficient, some parts of the transformer may overheat. Both heat generation and cooling are generally inhomogenously distributed in the transformer, and some locally overheating portions (hot spots) in the transformer may therefore be present. Such local overheating can reduce the transformer's life-time and reliability drastically.

Therefore, various cooling schemes for cooling the transformers are used. For example, U.S. Pat. No. 2,751,562 describes a dry-type transformer with air cooling. The transformer comprises a baffle member extending from an inner surface of the transformer casing to adjacent the outer periphery of a winding of the transformer, with a space between the outer periphery of the winding member and the adjacent edge of the baffle member.

WO 02082478 describes a liquid cooled and liquid immersed single phase transformer which is enclosed in a tank and uses a pipe system to guide in parallel the cooling liquid through cylindrical chambers surrounding the windings of a first and a second core limb respectively.

GB 691849 describes a liquid cooled transformer which is enclosed in a tank and in which tank the cooling liquid is guided in parallel trough fluid ducts of each of the two coil arrangements from an inlet on the bottom of the side wall of the tank to an outlet on the top of the side wall of the tank. A diaphragm with orifices is provided forcing the cooling liquid through the orifices into the space between the exterior surface of the magnetic core legs and an adjacent cylinder carrying the transformer coils.

U.S. Pat. No. 2,388,565 describes an oil-immersed transformer arranged in a tank with a series cooling circulation which is provided through the inner ducts of a first and a second coil arrangement. The oil circulates from an intake port on the bottom side through various ducts of the first coil arrangement and passes out into a compartment along the outside of the first and second coil arrangement. Then, the oil circulates from the compartment into various ducts of the second coil arrangement and passes out via a separate chamber on the bottom side below the second coil arrangement through an exhaust opening.

U.S. Pat. No. 2,615,075 describes an oil-immersed transformer provided with a cooler in form of a radiator outside the transformer tank. The oil circulates form the bottom side to the top side of the tank through fluid ducts which are formed between the magnetic core and surrounding coils.

Other transformers with cooling means of that class are described for example in DE 909122, DE 1563160, U.S. Pat. No. 2,927,736 and U.S. Pat. No. 2,459,322.

However, with the above transformer the cooling efficiency leaves room to be improved.

SUMMARY OF THE INVENTION

In view of the above, an electrical transformer according to claim 1, and a method according to claim 13 are provided. Further advantages, features, aspects and details that can be combined with embodiments described herein are evident from the dependent claims, the description and the drawings.

According to a first aspect, an electrical transformer comprises an enclosure; a magnetic core assembly arranged within the enclosure, the magnetic core assembly having at least a first core limb; a first coil assembly is co-axially disposed about the first core limb and radially separated therefrom by an axially-extending first inner fluid duct situated between the first core limb and the first coil assembly, the first coil assembly having a first outermost coil; and at least one diaphragm arranged within the enclosure, the diaphragm being essentially sealed to the first outermost coil.

The magnetic core assembly may further comprise a second core limb, and the electrical transformer may also comprise a second coil assembly having a second outermost coil. The second coil assembly may be co-axially disposed about the second core limb and radially separated therefrom by an axially-extending second inner fluid duct situated between the second core limb and the second coil assembly. The at least one diaphragm may be essentially sealed to the second outermost coil and preferably also to an outermost coil of a third coil assembly, if present, and/or possibly also to at least one portion of the core assembly. The at least one diaphragm may be arranged for guiding a cooling fluid in series or in parallel through the first inner fluid duct and through the second inner fluid duct.

According to a further aspect, an electrical transformer comprises an enclosure; a magnetic core assembly arranged within the enclosure, the magnetic core assembly having at least a first core limb arranged within the enclosure; a first coil assembly co-axially disposed about the first core limb and radially separated therefrom by an axially-extending first inner fluid duct situated between the first core limb and the first coil assembly, the first coil assembly having a first outermost coil; at least one diaphragm arranged within the enclosure for guiding a cooling fluid through the first inner fluid duct and thereafter past the first outermost coil. The cooling fluid does not need to flow past the first outermost coil directly after flowing through the first inner fluid duct, i.e. there may be some flow in between. On the other hand, the flow described herein should be within one single cooling cycle, i.e. in the case of a circulating cooling fluid, the fluid may not e.g. be re-cooled in a heat exchanger between two of the steps described herein as following one after the other.

The first and the second core limb may be parallel to each other. Further, the at least one diaphragm may be arranged for guiding the cooling fluid through the first inner fluid duct and the second inner fluid duct in zig zag. Here, zig zag means that the at least one diaphragm is arranged for guiding the cooling fluid along a cooling fluid path having a first portion in the first inner fluid duct and a second portion in the second inner fluid duct, the first and second portion being antiparallel to each other. In the case of three limbs, the cooling fluid path has a third portion in the third inner fluid duct, and the second portion is antiparallel to the first portion and to the third portion.

Further, the at least one diaphragm may be arranged for guiding the cooling fluid past an outside of the first outermost coil after having been guided through the first and/or the second inner fluid duct, possibly with other guiding or cooling steps in between, e.g. the step of guiding the cooling fluid through a third inner fluid duct.

Further, the enclosure may have at least one cooling fluid inlet for letting in cool cooling fluid before cooling and at least one a cooling fluid outlet for letting out heated cooling fluid after cooling; here the cooling fluid is in particular air. The outlet may in particular be arranged at a side of the transformer enclosure facing an outside of at least one of the coil assemblies, and at an axial height between the ends of the coil assembly. The outlet may be arranged at a side of the enclosure essentially parallel to the axes of the first and second coil assemblies.

Further, the enclosure may be sealed. The transformer may further comprise a heat exchanger for cooling the cooling fluid after a cooling cycle has been completed. The cooling fluid can be a cooling gas, such as air, N2, and/or SF6.

The electrical transformer may further comprise a fluid flow generating device for actively generating a flow or circulation of the cooling fluid, especially a gas fan in the case of the fluid being a gas. The gas fan may be adapted for creating a certain pressure difference within the enclosure. The at least one diaphragm may be arranged such that the pressure difference promotes or guides the flow of the cooling gas as described herein.

The first coil assembly may comprise a plurality of coils co-axially disposed about the first core limb. Further, the coils may be radially separated from one another by at least one first axially-extending inter-coil fluid duct situated between the coils of the first coil assembly. The at least one diaphragm may be arranged for guiding the cooling fluid in parallel through the first inner fluid duct and the at least one first inter-coil fluid duct.

The first coil assembly may comprise a high-voltage coil and a low-voltage coil, especially the high-voltage coil being the outermost coil of the first coil assembly. The same may also apply for the second and the third coil assembly, if present.

The magnetic core assembly may further have a third core limb, and the electrical transformer may further comprise a third coil assembly co-axially disposed about the third core limb and radially separated therefrom by an axially-extending third inner fluid duct situated between the third core limb and the third coil assembly. The at least one diaphragm may be arranged for guiding the cooling fluid in series through the first, second and third inner fluid duct.

The diaphragm may essentially be sealed to a portion of the enclosure. The first core limb and the second core limb may extend in parallel to each other along a vertical axis (this defines a vertical axis or direction). Then, the at least one diaphragm may have a horizontal portion extending in a horizontal plane (i.e. a plane substantially perpendicular to the vertical axis) and a vertical portion extending in a vertical plane (i.e. a plane substantially parallel to the vertical axis). The horizontal portion and the vertical portion may be connected by a joint portion essentially sealed for the cooling air such as to deflect the cooling air. The joint portion may be L- or T-shaped. The diaphragms may comprise at least two horizontal diaphragm portions (possibly vertically displaced with respect to one another) and at least two vertical diaphragm portions (each possibly connected to a respective one of the horizontal diaphragm portions by a respective L-shaped joint portion). The diaphragm may extend from one side to the other of the enclosure.

The electrical transformer may be a rectifier (also called converter) transformer. Further, the electrical transformer may be adapted for an input voltage of more than 1 kV. The transformer may be an outdoor transformer.

According to a further aspect, a method of cooling an electrical transformer using a cooling fluid is provided. The electrical transformer can be any transformer described herein. The method comprises: guiding the cooling fluid through the first inner fluid duct thereby cooling the first core limb and the first coil assembly at least partially; and guiding the cooling fluid from the first inner fluid duct through the second inner fluid duct thereby cooling the second core limb and the second coil assembly at least partially.

According to a further aspect, a method of cooling an electrical transformer using a cooling fluid comprises: guiding the cooling fluid through the first inner fluid duct thereby cooling the first core limb and the first coil assembly at least partially; and guiding the cooling fluid having been heated within the first inner fluid duct past the first outermost coil thereby cooling the first outermost coil.

The invention is also directed to apparatuses for carrying out the disclosed methods and including apparatus parts for performing each described method steps. These method steps may be performed by way of hardware components, a computer programmed by appropriate software, by any combination of the two or in any other manner. Furthermore, the invention is also directed to methods by which the described apparatus operates. It includes method steps for carrying out every function of the apparatus or manufacturing every part of the apparatus.

BRIEF DESCRIPTION OF THE FIGURES

The invention will be better understood by reference to the following description of embodiments of the invention taken in conjunction with the accompanying drawings, wherein.

DETAILED DESCRIPTION OF THE FIGURES AND OF EMBODIMENTS

Reference will now be made in detail to the various embodiments, one or more examples of which are illustrated in each figure. Each example is provided by way of explanation and is not meant as a limitation. For example, features illustrated or described as part of one embodiment can be used on or in conjunction with any other embodiment to yield yet a further embodiment. It is intended that the present disclosure includes such modifications and variations.

Within the following description of the drawings, the same reference numbers refer to the same or to similar components. Generally, only the differences with respect to the individual embodiments are described. Unless specified otherwise, the description of a part or aspect in one embodiment applies to a corresponding part or aspect in another embodiment as well.

Figure 1:
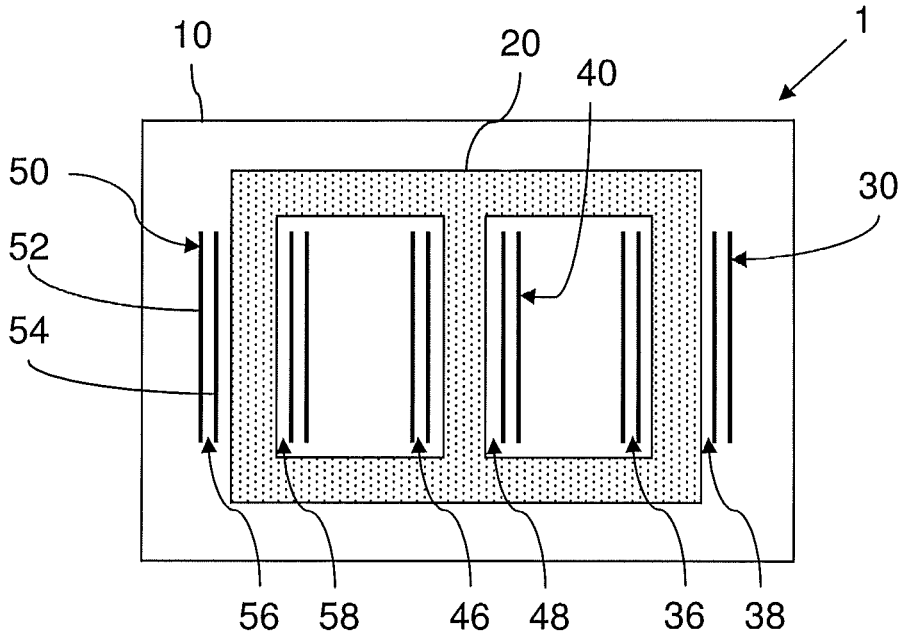
FIG. 1 is a cross-sectional side view of an electrical transformer, included herein for illustrative purposes.

FIG. 1 is a cross-sectional side view of a dry-type electrical transformer 1. Compared to oil-immersed transformers, such a dry-type transformer can be installed closer to the final point of utilization consequently reducing load cable losses, as they have almost no risk of fire and explosion. The absence of flammable and contaminating liquids also makes dry transformers attractive for applications with very strict safety and environmental requirements. On the other hand, the thermal design of such a dry transformer is demanding.

The transformer 1 includes an enclosure 10 defining an inner enclosure volume. The enclosure may include e.g. stainless steel, or some other sufficiently robust material. The transformer 1 further includes a three-limb core 20 and three coil assemblies 30, 40, 50, each coil assembly placed around a respective limb of the core 20. The limbs are cylindrically shaped, and also the coil assemblies are cylindrically shaped and concentrically arranged relative to the respective limb. Alternatively, e.g. a rectangular shape of the limb and the coils is possible, in which case again the coil assembly can be co-axially arranged relative to the respective limb. The core 20 is generally ferromagnetic and can include e.g. ferromagnetic iron.

Each of the coil assemblies 30, 40, 50 comprises two coils (e.g. coils 52 and 54 of the third coil assembly 50) co-axially disposed about the respective core limb. Also, a different number of coils is possible, e.g. one coil, or three coils per coil assembly. The coil assembly can comprise e.g. a HV coil (adapted for a voltage of above 1 kV) and/or an LV coil. For example, the inner coil 54 may be an LV coil, and the outer coil 52 may be a HV coil, or vice versa.

Electromagnetic losses, as a source of heat, develop in both the core (the dominant losses being hysteresis and eddy-current losses) and windings (the dominant losses being Ohmic and eddy-current losses). Here, the heat is taken away by a flow of air or of some other cooling fluid (in the following, only air cooling will be described for definiteness). For efficient cooling, the cooling gas is circulated through cooling gas ducts formed at the coil assemblies 30, 40, 50. For example, the coil assembly 50 (more precisely, its inner coil 54) is radially separated from the core limb of core 20, thereby defining an inner gas duct 58 situated between the core limb and the coil assembly 50. Further, the coils 52 and 54 are radially separated from one another, thereby defining an inter-coil gas duct 56 situated between these coils. The above applies equally to the other coil assemblies 30 and 40. Air as cooling gas circulating through these gas ducts and along the outside of the coil assemblies 30, 40, 50 can take away some heat.

The air may enter the enclosure 10 through an inlet and exit from the enclosure 10 through an outlet of the enclosure 10 (not shown in FIG. 1). Typically, the inlet is placed at the bottom part of the enclosure, the outlet for the heated air is placed at the top part of the enclosure. In case of demanding ambient conditions, which may be present, e.g., on ships or in mines, the enclosure 10 can also be completely sealed. Then, a heat exchanger system can be used for transferring the heat out of the enclosure 10. Within the enclosure 10 a stream of cooling air along the transformer and the heat exchanger can be enforced by using one or several fans or similar devices.

The transformer of FIG. 1 may comprise, according to a further illustrative example, a plate (not shown in FIG. 1) positioned horizontally in the enclosure 10, i.e., in a plane orthogonal to the axes of the coil assemblies 30, 40, 50, thereby dividing the inner volume of the enclosure 10 in an upper volume and a lower volume (each of these volumes being approximately half of the enclosure volume, i.e. the plate is located approximately in the middle). The plate has three openings for the coil assemblies 30, 40, 50, the openings being dimensioned such that there are gaps between the plate and the outer circumferences of the respective coil assemblies 30, 40, and 50. Thus, the upper volume and lower volume communicate through the ducts (e.g. ducts 56 and 58 of coil assembly 50), and through the gaps between the plate and the outer coil assembly circumferences.

Figure 2:
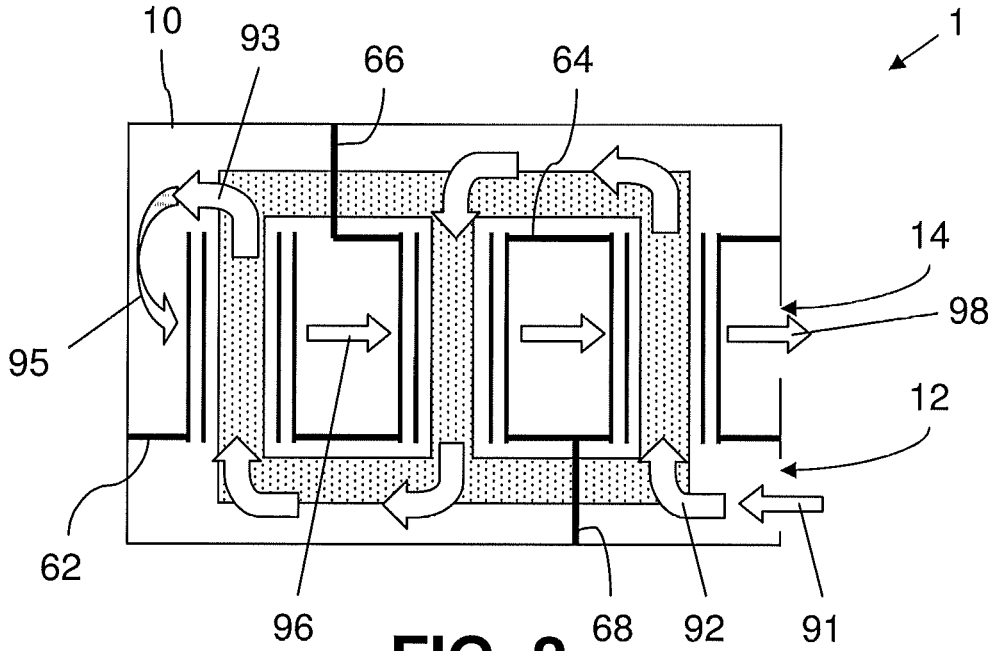
FIG. 2 is a cross-sectional side view of an electrical transformer according to a first embodiment of the invention.

FIG. 2 is a cross-sectional side view of an electrical transformer 1 according to a first embodiment of the invention. The transformer has the elements of the transformer of FIG. 1 and possibly of any of its variations described above, so that the above description of FIG. 1 also applies to the electrical transformer 1 of FIG. 2 unless noted otherwise.

In addition to the elements shown in FIG. 1, FIG. 2 shows an air inlet 12 and an air outlet 14 of the enclosure 10. The air inlet 12 allows cool air to enter the enclosure for cooling the transformer, and the outlet 14 allows the air to exit the enclosure after cooling, i.e. after heat has been transferred to the air. The outlet 14 is arranged at a side of the enclosure 10, i.e. an enclosure wall more or less parallel to the axes defined by the coil assemblies 30, 40, 50, such that the outlet 14 faces the outside of the coil assembly 30, and at an axial (vertical) height between the ends of the coil assembly 30.

Further, a number of diaphragms 62, 64, 66, 68 is arranged within the enclosure. The diaphragms are made e.g. of an insulating material such as a composite material, a resin, etc. The diaphragm 62 is positioned horizontally in the enclosure 10, in a plane orthogonal to the axes of the coil assemblies 30, 40, 50. The diaphragm 62 has an opening for the coil assembly 30 (further openings for the remaining coil assemblies are described further below). Further, at the edges of this opening, the diaphragm 62 is essentially sealed to the outermost coil of the coil assembly 30 (this outermost coil is in the following referred to as first outermost coil; it is generally a HV coil), such that there are essentially no gaps between the diaphragm 62 and the outer circumference of the coil assembly 30. Herein, essentially no gaps means that there are no gaps or leaks that would significantly change the way in which the air is guided by the diaphragm 62 (wherein a certain tolerance of misguided air flow due to the sealing being imperfect is acceptable). Further, the diaphragm 62 extends to a side face of the enclosure 10 (the face having the inlet 12) and to a front and back face of the enclosure 10 (the faces in the drawing plane of FIG. 2) and is essentially sealed to these faces. Further, a vertical diaphragm 68 is sealed to the diaphragm 62 and to a bottom face of the enclosure 10, and to the front and back face of the enclosure 10 as well.

Thereby, as a general aspect independent of the present embodiment, the diaphragms 62 and 68 form a channel between the inlet 12 and the air ducts 36, 38 of the first coil assembly 30, guiding the air from the inlet 12 to the air ducts 36, 38 but not to the outside of the first outermost coil. The channel has essentially no further openings than the inlet 12 and the air duct(s) 36, 38 of the first coil assembly 30.

Further, the diaphragm 64 is also positioned horizontally in the enclosure 10, and vertically (i.e. axially) offset with respect to the diaphragm 62. The diaphragm 64 has respective openings for the first and second coil assemblies 30 and 40. Further, at the edges of these openings, the diaphragm 64 is essentially sealed to the first and second outermost coil, respectively (the second outermost coil being the outermost coil of the second coil assembly 40), such that there are essentially no gaps between the diaphragm 64 and the outer circumferences of the coil assemblies 30 and 40. Further, the diaphragm 64 extends to the side face of the enclosure 10 closest to the coil assembly 30 and to the front and back face of the enclosure 10 and is essentially sealed to these faces. Further, a vertical diaphragm 66 is sealed to the diaphragm 64 and to a top face of the enclosure 10, and to the front and back face of the enclosure 10 as well.

Thereby, as a general aspect independent of the present embodiment, the diaphragms 64 and 66 form a channel between the air ducts 36, 38 of the first coil assembly 30 and the air ducts 46, 48 of the second coil assembly 40, guiding the air from the air ducts 36, 38 to the air ducts 46, 48 but not from or to the outside of the first/second outermost coil. The channel has essentially no further openings than the air duct(s) 36, 38, 46, 48 of the first and second coil assembly 30, 40. This way the flow is essentially wholly driven from the air ducts 36, 38 within the first coil assembly 30 to the air ducts 46, 48 of the second coil assembly 40.

Further, the diaphragm 62 has respective openings for the coil assemblies 40 and 50. At the edges of these openings, the diaphragm 62 is essentially sealed to the second and third outermost coil, respectively (the third outermost coil 52, see also FIG. 1, being the outermost coil of the third coil assembly 50), such that there are essentially no gaps between the diaphragm 62 and the outer circumferences of the coil assemblies 40 and 50. Further, the diaphragm 62 extends to the side face of the enclosure 10 closest to the coil assembly 50 and is essentially sealed thereto, i.e. the diaphragm 62 extends from wall to wall of the enclosure 10.

Thereby, as a general aspect independent of the present embodiment, the diaphragm 62 and the vertical diaphragm 68 sealed thereto (see above) form a channel between the air ducts 46, 48 of the second coil assembly 40 and the air ducts 56, 58 of the third coil assembly 50, guiding the air from the air ducts 46, 48 to the air ducts 56, 58 but not from or to the outside of the second/third outermost coil. The channel has essentially no further openings than the air duct(s) 46, 48, 56, 58 of the second and third coil assembly 40, 50.

As a further general aspect independent of the present embodiment, there is an extra-coil volume for the cooling air, the volume surrounding the outside of the third outermost coil. Further, the extra-coil volume also surrounds the outside of the second and first outermost coil, and extends to the outlet 14. An exit (top side) of the air ducts 56, 58 is connected to the extra-coil volume so that air can flow directly from the air ducts 56, 58 to the extra-coil volume.

As a further general aspect, the diaphragms 62, 64 are flush with the axial ends of the respective coil assemblies. As a further general aspect, the outlet 14 is arranged between the horizontal planes defined by the respective axial ends of the coil assemblies 30, 40 and 50.

The above-described diaphragms 62, 64, 66, and 68 guide the cooling air in the following manner: First, the cooling air entering the enclosure 10 via the inlet 12 (the cooling air flow being represented by the arrow 91) is guided by the diaphragms 62 and 68 to flow into and through the air ducts 36, 38, thereby cooling the first core limb and the first coil assembly 30, but to essentially not directly flow along the outside of the first outermost coil. Thereafter, the air exiting from the air ducts 36, 38 is guided by the diaphragms 64 and 66 to flow into and through the air ducts 46, 48, thereby cooling the second core limb and the second coil assembly 40, but to essentially not directly flow along the outside of the second outermost coil. Thereafter, the air exiting from the air ducts 46, 48 is guided by the diaphragms 62 and 68 to flow into and through the air ducts 56, 58, thereby cooling the third core limb and the third coil assembly 50, but to essentially not directly flow along the outside of the third outermost coil. Thereafter, the air exiting from the air ducts 56, 58 (represented by arrow 93) is guided to flow inside the extra-coil volume (arrow 95) along the outsides of the third, second and first outermost coil (arrow 96), thereby cooling their outer surfaces. Thereafter, the air is guided to the outlet 14 (arrow 98).

Fans (not shown) may provide a pressure drop that enhances the above-described air flow. The fans may be provided e.g. at the inlet 12 and/or at the outlet 14, but also within other parts of the enclosure 10 along the air flow.

In summary and according to an aspect independent of the shown embodiment, the diaphragms 62, 64, 66, 68 guide the air essentially in series through the first inner fluid duct 38 and the second inner fluid duct 48 (and also, if present, through the third inner fluid duct 58), such that the air flows first through the first inner fluid duct 38 and thereafter through the second inner fluid duct 48 (and, if present, thereafter through the third inner fluid duct 58). According to a related aspect, the air is guided to flow through ducts of the first coil assembly 30, the second coil assembly 40 and the third coil assembly 50 in series.

This series flow is achieved by the diaphragms 62, 64 being essentially sealed to the outermost coils of the coil arrangements, such that air flowing from a volume on one side of these diaphragms to a volume on the other side of these diaphragms is forced to flow through the respective insides of the coil arrangements, i.e. through the ducts 36, 38; 46, 48; 56, 58.

According to a further aspect, the diaphragms 62, 64, 66, 68 guide the air flow such that the insides of the coil arrangements are cooled first. Only in a later step the outer surface of the outermost coils is cooled by the air. The inside of the coil arrangements needs more cooling because generally more heat is generated, less surface is available for heat removal, and radiation cooling is not available as a cooling channel. Thus, cooler air is used for cooling the inside portions of the coil assemblies that need more cooling, and hotter air is used when cooling the outside portions that need less cooling.

Thus, the diaphragms are arranged in such a way to guide the flow smoothly around the core and the coils, and to obtain a more efficient cooling, making the air behave as the working fluid in cooling spirals.

The arrangement of FIG. 2 has the following further advantages: Because the air is guided closely to the heated surfaces at high speed by the geometry and arrangement of the diaphragms and the coil assemblies, an efficient cooling is possible. Hence, a significant reduction of the temperature in both the coils and core is achieved. Especially, efficient cooling is possible in the case of dry-type transformers with enclosure, which have a number of advantages with respect to oil transformers but which were, in the past, more difficult to cool. Therefore, using the arrangement described herein, it is possible using dry-type transformers in cases for which it was previously more difficult due to cooling challenges.

Further, the efficient cooling is possible without a significant increase of material or manufacturing cost. Possibly the material or cost of the transformer can even be decreased because of the more efficient cooling.

Figure 3:
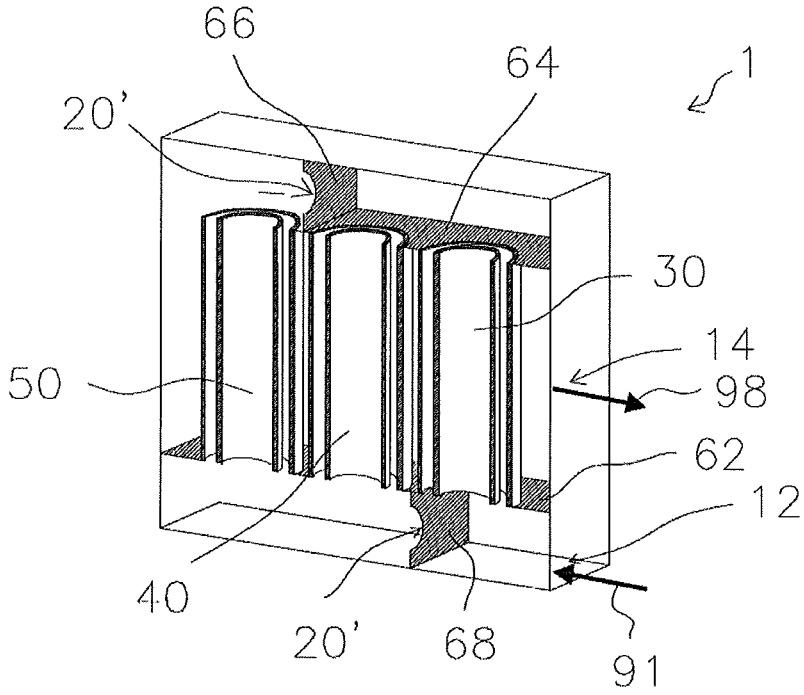
FIG. 3 is a perspective view of the electrical transformer of FIG. 2.

FIG. 3 shows the electrical transformer of FIG. 2 in a perspective vertically cut view. The description of FIG. 2 applies to FIG. 3 as well. In FIG. 3, the magnetic core 20 is not shown in order to show the other elements more clearly. The vertical diaphragms 66, 68 have round openings 20' allowing the magnetic core to pass through the diaphragms. The diaphragms 66 and 68 are essentially sealed to the magnetic core at the edges of the openings 20'. From the shape of the openings 20', it can be seen that the magnetic core 20 of FIG. 2 has a circular cross-section.

Figure 4:
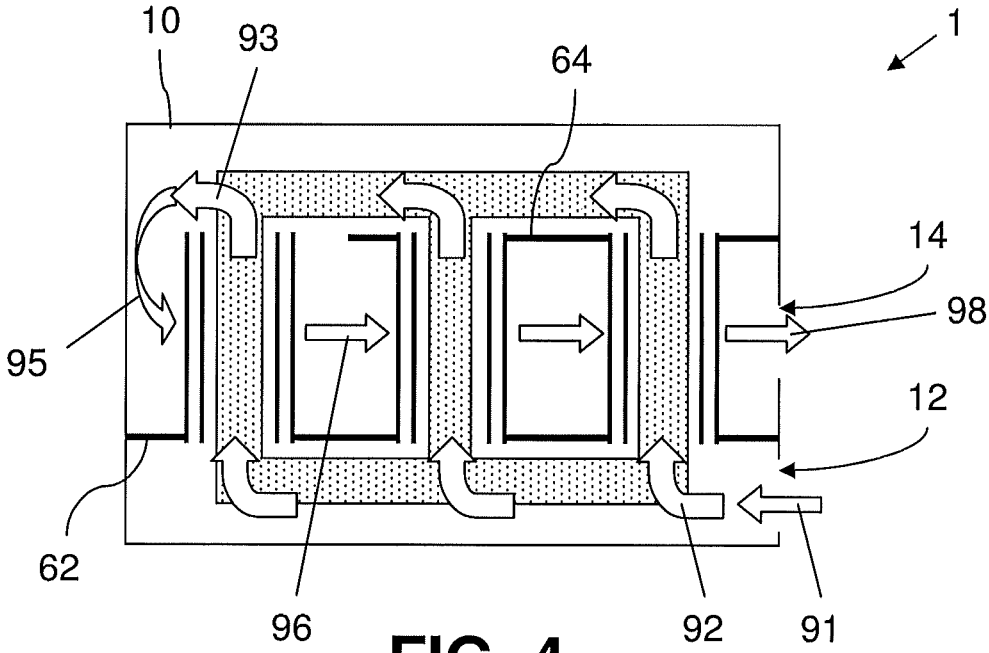
FIG. 4 is a cross-sectional side view of an electrical transformer according to a second embodiment of the invention.

FIG. 4 is a cross-sectional side view of an electrical transformer according to a second embodiment of the invention, which differs from the first embodiment only in the arrangement of the diaphragms. The other aspects of the description of FIGS. 1 to 3 apply to FIG. 4 as well.

In the enclosure 10 of the transformer of FIG. 4, diaphragms 62 and 64 are arranged. The diaphragm 62 is positioned horizontally in the enclosure 10 (in a plane orthogonal to the axes of the coil assemblies 30, 40, 50). The diaphragm

62 has three openings, one for each of the coil assemblies 30, 40 and 50. Further, at the edges of the respective openings, the diaphragm 62 is essentially sealed to the outermost coil of the first coil assembly 30 (outermost first coil), the outermost coil of the second coil assembly 40 (outermost second coil), and to the outermost coil of the third coil assembly 50 (outermost third coil), such that there are essentially no gaps between the diaphragm 62 and the outer circumference of the respective coil assembly 30, 40 and 50. Further, the diaphragm 62 extends inside the enclosure 10 from face to face and is essentially sealed to the faces of the enclosure.

Thereby, as a general aspect independent of the present embodiment, the diaphragm 62 forms a channel between the inlet 12 and the air ducts of the first, second and third coil assembly 30, 40 and 50. The channel leads from the inlet 12 to these air ducts in parallel. The channel does not (directly) lead to the outside of the first, second or third outermost coil. The channel has essentially no further openings than the inlet 12 and the air ducts of the first, second and third coil assembly 30, 40, 50.

Further, the diaphragm 64 is also positioned horizontally in the enclosure 10, and vertically (i.e. axially) offset with respect to the diaphragm 62. The diaphragm 64 has respective openings for the coil assemblies 30 and 40. Further, at the edges of these openings, the diaphragm 64 is essentially sealed to the first and second outermost coil, respectively, such that there are essentially no gaps between the diaphragm 64 and the outer circumferences of the coil assemblies 30 and 40.

The diaphragm 64 defines a channel leading from the upper openings of the coil assemblies 30 and 40 to an extra-coil volume for the cooling air, the volume being in direct contact with the outsides of the first, second and third outermost coil 30, 40, 50.

As a further general aspect, the diaphragms 62, 64 are flush with the respective axial ends of the coil assemblies.

The above-described diaphragms 62 and 64 guide the cooling air in the following manner: First, the cooling air entering the enclosure 10 via the inlet 12 (arrow 91) is essentially guided by the diaphragm 62 to flow into and through the air ducts of the first, second and third coil assemblies 30, 40, 50 in parallel (e.g. arrow 92), but to not directly flow along the outside of their outermost coils. Thereby, the air cools the first, second and third core limbs and the inside of the first, second and third coil assemblies 30, 40, 50. Thereafter, the air exiting from the air ducts of the coil assemblies 30, 40, 50 (e.g., arrow 93) is essentially guided to flow inside the extra-coil volume (arrow 95), moving along the outsides of the third, second and first outermost coils (arrow 96), thereby cooling their outer surfaces. Thereafter, the air is guided to the outlet 14 (arrow 98).

In summary and according to an aspect independent of the shown embodiment, the diaphragms 62, 64, 66, 68 guide the air essentially in parallel through the first inner fluid duct 38 and the second inner fluid duct 48 (and also, if present, through the third inner fluid duct 58, see also FIG. 1). According to a related aspect, the air is guided to flow first through the insides of the coil arrangements, and thereafter, along the outer surfaces of their outermost coils. The arrangement of FIG. 4 has the further advantage that the coils are cooled evenly.

Also, further alternative arrangements of the diaphragms are possible. For example, as an alternative to the embodiment of FIG. 4, the upper diaphragm 64 does not need to be sealed to the outermost coils, and its size can be reduced or it can even be omitted altogether. For example, the size could be reduced such that the diaphragm 64 abuts the coil assembly 40. Alternatively, the size of the upper diaphragm 64 could be extended such as to abut or even encompass the third coil assembly 50. Further, vertical diaphragms can provided dividing the enclosure into three separate volume portions, one per coil assembly, and providing a separate inlet and outlet for each of the volume portion.

As a further alternative to either the first or the second embodiment, the outlet could also be located at the top face of the enclosure, so that the air is guided out of the enclosure without passing through the inter-coil volume.

As a further modification to any of the transformers of FIGS. 2 to 4, the inlet 12 and outlet 14 can be omitted, such that the enclosure 10 is sealed from the outside. Then, a heat exchanger may be provided for taking away the heat from the circulating air (e.g. at the position of the outlet 14). A pump, fan or the like can be arranged such that there is an air flow from the former position of the outlet 14 to the former position of the inlet 12.

Further, instead of air, any other cooling fluid can be provided in any of the above-described aspects and embodiments. The cooling fluid can be a cooling gas (e.g., air; N2; SF6) or a cooling liquid such as e.g. a water-based or an oil-based coolant. In the case of a cooling liquid, the inlet 12 and outlet 14 may be connected to a cooling liquid supply/drain or to a heat exchanger. Further, pumps may be provided for enforcing a cooling liquid flow.

The invention claimed is:

1. Electrical dry-type transformer, comprising:

an enclosure;

a magnetic core assembly arranged within the enclosure, the magnetic core assembly having a first core limb, a second core limb and a third core limb;

at least three coil assemblies, of which:

a first coil assembly is co-axially disposed about the first core limb and radially separated therefrom by an axially-extending first inner gas duct situated between the first core limb and the first coil assembly, the first coil assembly having a first outermost coil;

a second coil assembly is co-axially disposed about the second core limb and radially separated therefrom by an axially-extending second inner gas duct situated between the second core limb and the second coil assembly, the second coil assembly having a second outermost coil; and a third coil assembly is co-axially disposed about the third core limb and radially separated therefrom by an axially-extending third inner gas duct situated between the third core limb and the third coil assembly the third coil assembly having a third outermost coil;

at least two diaphragms arranged within the enclosure, the at least two diaphragms being essentially sealed to the first outermost coil and being essentially sealed to a portion of the enclosure and being arranged for guiding a cooling gaseous fluid in series through the first inner gas duct, through the second inner gas duct and through the third inner gas duct, wherein a horizontal and a vertical portion of each of the at least two diaphragms are connected by a joint portion essentially sealed for the cooling gaseous fluid so as to deflect the cooling gaseous fluid and so as to guide the cooling gaseous fluid during operation to flow inside an extra-coil volume along outsides of the third, second and first outermost coils after having been guided through the third inner gas duct.

2. The electrical transformer according to claim 1, wherein the at least two diaphragms are arranged within the enclosure for guiding a cooling gaseous fluid essentially in series through the first inner gas duct and the second inner gas duct, such that during operation the at least one diaphragm guides the cooling gaseous fluid to flow first through the first inner gas duct for cooling the first core limb and the first coil assembly at least partially and thereafter through the second inner gas duct for cooling the second core limb and the second coil assembly at least partially.

3. The electrical transformer according claim 1, wherein the first and the second core limbs are parallel to each other, and wherein at least one of the two diaphragms is arranged for guiding the cooling gaseous fluid through the first inner gas duct and the second inner gas duct in a zig zag manner.

4. The electrical transformer according to claim 1, wherein the enclosure comprises:

at least one cooling fluid inlet; and at least one a cooling gaseous fluid outlet.

5. The electrical transformer according to claim 1, wherein the enclosure is sealed, the transformer comprising:

a heat exchanger for cooling the cooling fluid after a cooling cycle has been completed.

6. The electrical transformer according to claim 1, wherein the first coil assembly comprises:

a plurality of coils co-axially disposed about the first core limb.

7. The electrical transformer according to claim 1, wherein the first core limb and the second core limb extend in parallel to each other along a vertical axis, and wherein each of the at least two diaphragms has the horizontal portion extending in a horizontal plane and the vertical portion extending in a vertical plane.

8. The electrical transformer according to claim 7, wherein the vertical portion of each diaphragm is sealed to the diaphragm and to a top face of the enclosure, and to front and back faces of the enclosure.

9. The electrical transformer according to claim 7, wherein the vertical portion of each diaphragm is sealed to the diaphragm and to a bottom face of the enclosure, and to front and back faces of the enclosure.

10. The electrical transformer according claim 1, wherein one of the at least two diaphragms is positioned vertically offset with respect to another of the at least two diaphragms.

11. The electrical transformer according to claim 1, wherein the at least one of the two diaphragms comprises:

at least two horizontal diaphragm portions and at least two vertical diaphragm portions.

12. Method of cooling an electrical dry-type transformer using a cooling gas, the electrical transformer having an enclosure, at least two diaphragms arranged within the enclosure; a magnetic core assembly arranged within the enclosure, the magnetic core assembly having a first core limb, a second core limb and a third core limb; and at least three coil assemblies, of which:

a first coil assembly is co-axially disposed about the first core limb and radially separated therefrom by an axially-extending first inner gas duct situated between the first core limb and the first coil assembly, the first coil assembly having a first outermost coil;

a second coil assembly is co-axially disposed about the second core limb and radially separated therefrom by an axially-extending second inner gas duct situated between the second core limb and the second coil assembly, the second coil assembly having a second outermost coil;

a third coil assembly co-axially disposed about the third core limb and radially separated therefrom by an axially-extending third inner gas duct situated between the third core limb and the third coil assembly, the third coil assembly having a third outermost coil;

the method comprising:

guiding the cooling gaseous through the first inner gas duct thereby cooling the first core limb and the first coil assembly at least partially;

guiding the cooling gaseous fluid from the first inner gas duct through the second inner gas duct for cooling the second core limb and the second coil assembly at least partially;

guiding the cooling gaseous fluid from the second inner gas duct through the third inner gas duct for cooling the third core limb and the third coil assembly at least partially; and deflecting and guiding the cooling gaseous fluid by the a least two diaphragms to flow inside an extra-coil volume along outsides of the third, second and first outermost coils after having been guided through the third inner gas duct.

13. The electrical transformer according claim 2, wherein the first and the second core limbs are parallel to each other, and wherein at least one of the two diaphragms is arranged for guiding the cooling gaseous fluid through the first inner gas duct and the second inner gas duct in a zig zag manner.

14. The electrical transformer according to claim 12, wherein the enclosure comprises:

at least one cooling fluid inlet; and at least one a cooling gaseous fluid outlet.

15. The electrical transformer according to claim 12, wherein the enclosure is sealed, the transformer comprising:

a heat exchanger for cooling the cooling fluid after a cooling cycle has been completed.

16. The electrical transformer according claim 14, wherein the first coil assembly comprises:

a plurality of coils co-axially disposed about the first core limb.

17. The electrical transformer according to claim 15, wherein the first core limb and the second core limb extend in parallel to each other along a vertical axis, and wherein each of the at least two diaphragms has the horizontal portion extending in a horizontal plane and the vertical portion extending in a vertical plane.

18. The electrical transformer according to claim 16, wherein the vertical portion of each diaphragm is sealed to the diaphragm and to a top face of the enclosure, and to front and back faces of the enclosure.

19. The electrical transformer according to claim 16, wherein the vertical portion of each diaphragm is sealed to the diaphragm and to a bottom face of the enclosure, and to front and back faces of the enclosure.

20. The electrical transformer according claim 1, wherein one of the at least two diaphragms is positioned vertically offset with respect to another of the at least two diaphragms.

* * * * *